United States Patent [19]

Rahman

[11] 4,174,362

[45] Nov. 13, 1979

[54] HUMIDIFER

[75] Inventor: Michael Rahman, Winston-Salem, N.C.

[73] Assignee: Envirotech Corporation, Menlo Park, Calif.

[21] Appl. No.: 898,242

[22] Filed: Apr. 20, 1978

[51] Int. Cl.[2] ..... F24F 3/14

[52] U.S. Cl. ..... 261/90; 239/214.15; 239/214.21; 239/222.11; 239/224; 261/DIG. 15; 126/113

[58] Field of Search ..... 261/90, 91, 89, DIG. 15; 239/214.11, 214.15, 214.17, 214.21, 215, 222.11, 224; 126/113

[56] References Cited

U.S. PATENT DOCUMENTS

| | | | |
|---|---|---|---|
| 1,236,073 | 8/1917 | Fesler | 239/214.17 |
| 1,888,693 | 11/1932 | Powers | 239/214.15 |
| 2,025,526 | 12/1935 | Rodler | 239/214.17 |
| 2,129,215 | 9/1938 | Howse et al. | 261/90 |
| 2,163,474 | 6/1939 | Sloan | 261/30 |
| 2,342,596 | 2/1944 | North | 239/215 |
| 2,750,708 | 6/1956 | Handfield | 239/214.15 |
| 3,061,200 | 10/1962 | Ficker | 261/90 |
| 3,290,021 | 12/1966 | Blachly et al. | 261/91 |
| 3,365,181 | 1/1968 | Schwaneke | 261/91 |
| 3,408,154 | 10/1968 | Bachi, Jr. | 239/214.15 |
| 3,719,353 | 3/1973 | Cherne et al. | 261/90 |
| 3,855,369 | 12/1974 | Boler | 261/90 |

FOREIGN PATENT DOCUMENTS

| | | | |
|---|---|---|---|
| 168867 | 10/1922 | United Kingdom | 261/90 |

*Primary Examiner*—Frank W. Lutter
*Assistant Examiner*—Gregory N. Clements
*Attorney, Agent, or Firm*—William S. Bernheim; Michael J. Pollock

[57] ABSTRACT

A humidification apparatus including a housing, a fan assembly mounted in the housing and having conduits extending therein, a slinger assembly rotatably mounted in the housing adjacent to and coaxial with the fan assembly and having vanes on a surface thereof, and water feed means for delivering water through the conduits in the fan assembly to the surface of the slinger assembly.

2 Claims, 6 Drawing Figures

HUMIDIFER

BACKGROUND

The present invention relates to improvements in humidifying apparatus designed to maintain a properly humidified atmosphere in textile and other large industrial plants. More particularly, the invention relates to an improved centrifugal humidifying apparatus to increase humidification capacity.

A typical centrifugal humidifier is described in U.S. Pat. No. 2,163,474 to Sloan.

In another type of centrifugal humidifier, a disc is fixed to rotate with a hub of a fan. Water is fed to the disc from the larger end of a conical chamber formed in the hub. The face of the disc receiving the water is flat and unchanneled. In this humidifier if water is fed through the conical chamber in excess of a certain rate, gravity forces will cause a circumferentially uneven feed to the disc which is to say, a disproportionate amount of the water is fed from below the centerline of the conical chamber.

Heretofore, in these types of humidifiers, the capacity, in terms of the amount of water which can be entrained by the air, has been limited to an important degree by the surface tension of the feed water. The surface tension limits the film depth of the water moving outward on the discs.

The effectiveness of the shearing action at the periphery of the discs also limits the amount of water which can be entrained. Unless sheared effectively to generate a mist, additional water will not be entrained.

OBJECTS OF THE INVENTION

An object of this invention is to provide a humidifying apparatus with a fan assembly through which water is fed to a disc more evenly circumferentially than heretofore.

Another object is to provide a humidifying apparatus with a disc on which a deeper film of water can be maintained than heretofore and thereby increase the humidification capacity of the humidifying apparatus.

Yet another object is to provide a humidifying apparatus with a cooperative arrangement of a fan having an array of fins mounted thereto and a disc in which arrangement the shearing action at the periphery of the disc is more effective than heretofore.

BRIEF DESCRIPTION OF THE DRAWINGS

Further objects and advantages of the invention may be readily ascertained by reference to the following description and appended drawings, which are offered by way of description only and not in limitation of the invention, the scope of which is defined in the appended claims.

In the drawings.

PREFERRED EMBODIMENT OF THE INVENTION

Figure 1:
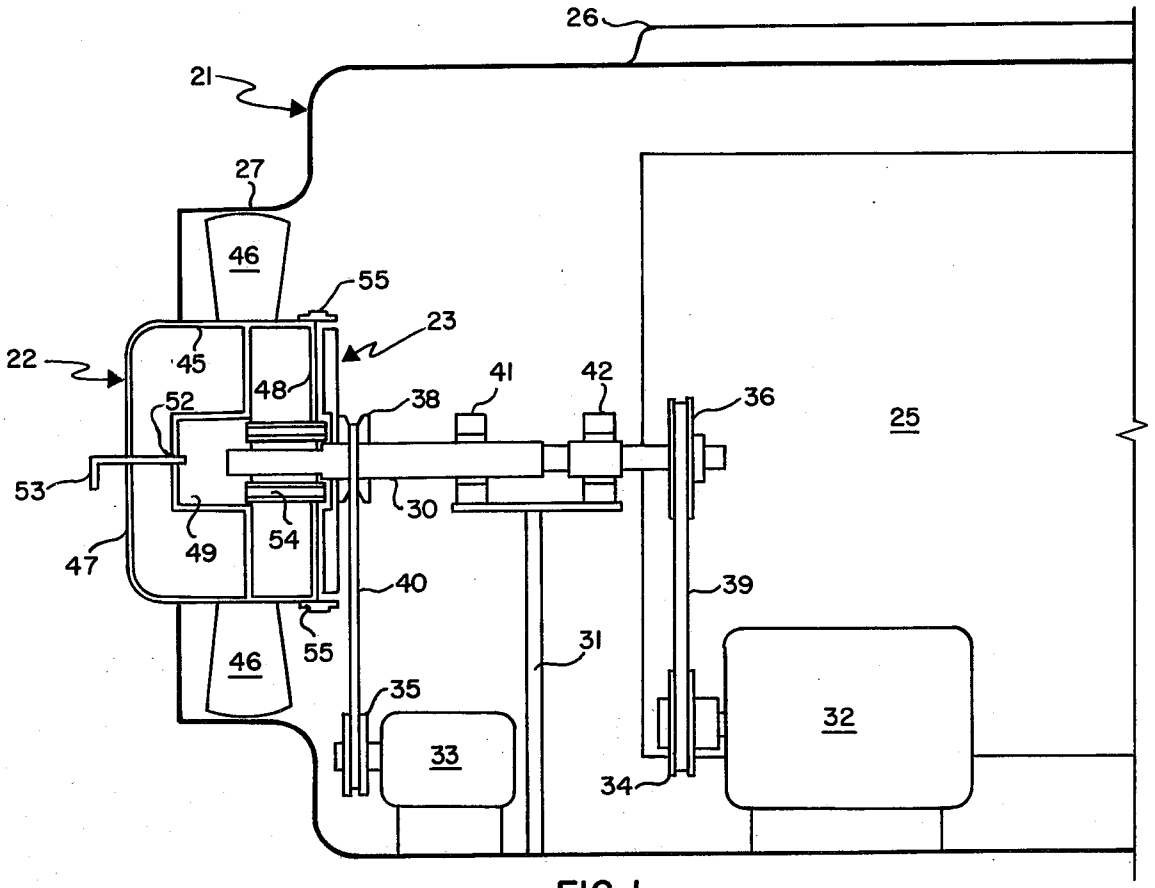
FIG. 1 is a partial sectional side view of a humidifying apparatus according to the invention.

As shown generally in FIG. 1, the humidifying apparatus includes a housing 21, a fan assembly 22 rotatably mounted in the housing 21, and a slinger assembly 23 rotatably mounted in the housing 21 adjacent to and coaxial with the fan assembly 22. The humidifying apparatus further includes conventional drive means 32 and 33 for rotating the fan assembly 22 and slinger assembly 23 independently of one another and water feed means for delivering water through the fan assembly 22 to the slinger assembly 23.

As further shown in FIG. 1, the housing 21 is formed to have inlets 25 and 26 for admitting air to the housing. In normal practice, inlet 25 would admit ambient air from the room in which the housng 21 is mounted and inlet 26 would admit fresh air. The housing 21 further includes cylindrical outlet passage 27 through which humidified air is discharged from the housing. A duct system (not shown) is normally connected to the outlet passage 27 so that the humidified air can be distributed to different points in a room. It should be understood that the illustrated housing 21 is conventional and that its exact configuration is not critical to the present invention.

A support means for the fan assembly 22 and slinger assembly 23 includes a rotatably shaft 30, and a shaft stand 31 with associated bearing assemblies 41 and 42 for supporting the shaft 30 in the housing 21. The shaft 30 extends through the slinger assembly 23 and preferably partially through the fan assembly 22.

Figure 5:
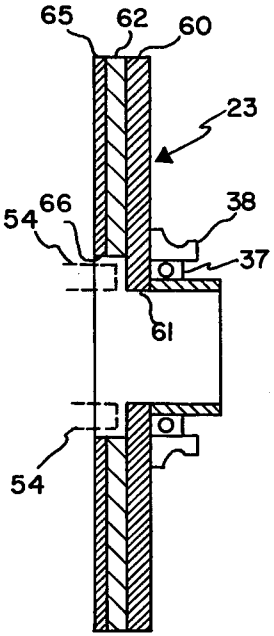
FIG. 5 is a side view of the slinger assembly shown in FIG. 4 viewed along lines 5—5 with conduits of the fan assembly superimposed with dashed lines.

The drive means includes motors 32 and 33 having sheaves 34 and 35 mounted respectively thereto. The drive means further includes a sheave 36 mounted on shaft 30, a bearing assembly 37 (FIG. 5) with which the slinger assembly 23 is rotatably mounted on shaft 30, and a sheave 38 mounted to the slinger assembly. Sheave 34 is connected to drive sheave 36 with an endless belt 39. Sheave 35 is connected to drive sheave 38 with an endless belt 40.

The fan assembly 22 is mounted adjacent the passage 27 and includes a fan hub 45 mounted coaxially to rotate with the shaft 30. The fan assembly 22 further includes conventional fan blades 46 mounted to the hub 45 to extend radially outward. The outer peripheries of the blades 46 are mounted in close proximity to the internal surface of the outlet passage 27.

The fan hub 45 includes first and second opposing ends 47 and 48. Inside the fan hub 45, a chamber 49 is formed to serve as a water plenum. Preferably the shape of the chamber 49 is cylindrical, but the shape can alternatively be that of a truncated cone with the larger diameter nearer the second end 48 of the fan hub 45.

Formed at the end of the chamber 49 nearest the first hub end 47 is an inlet 52 which is preferably coaxial to the shaft 30. A pipe 53, a part of the water feed means, is connected in flow communication to the chamber inlet 52 to feed water to the chamber 49.

From the end of the chamber 49 opposite the chamber inlet 52, three or more conduits 54 extend through the fan hub 45 in flow communication to deliver water from the chamber 49 to the second hub end 48 and hence to the slinger assembly 23. Preferably, the conduits 54 protrude from the second hub end 48 so that the conduits 54 extend within the slinger assembly 23.

Figure 2:
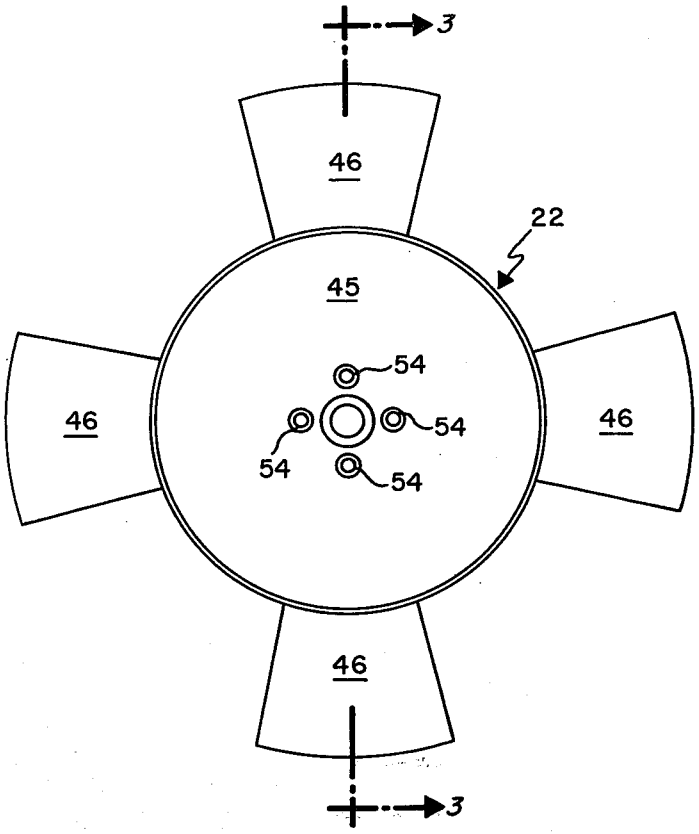
FIG. 2 is an end view to an enlarged scale of the fan assembly shown in FIG. 1 viewed from the slinger assembly side with the tubular member removed.

The conduits 54 as shown in FIG. 2 are equally spaced radially from the shaft 30 to define a circle on which the conduits 54 are evenly spaced. As is apparent, the conduits 54 feed water evenly around the defined circle to the slinger assembly 23 and the evenness of the feed is less susceptible to disruption due to gravity than previous designs.

Figure 3:
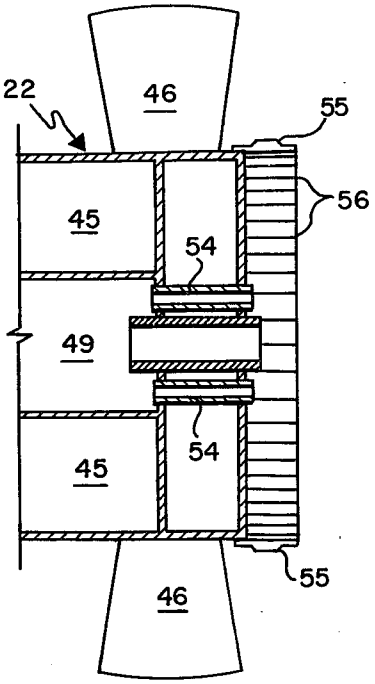
FIG. 3 is a partial side view of the fan assembly shown in FIG. 2 viewed along lines 3—3.

A tubular member 55, best shown in FIG. 3, is coaxially mounted to the fan hub 45 to rotate therewith. The tubular member 55 includes a plurality of fins 56 spaced circumferentially from one another to form a cylindrical-shaped array which extends outward from the second end 48 of the hub 45 to circumscribe the slinger assembly 23.

Returning to FIG. 1, the slinger assembly 23 is mounted on the shaft 30 adjacent the second end 48 of the fan hub 45. As shown in more detail in FIG. 4 and particularly FIG. 5, the slinger assembly 23 includes a first disc-shaped plate 60 through the center of which is formed a cylindrical passage 61 to accommodate the shaft 30. The outside diameter of the plate 60 is slightly less than the inside diameter of the array of the tubular member 55 (FIG. 1).

Figure 4:
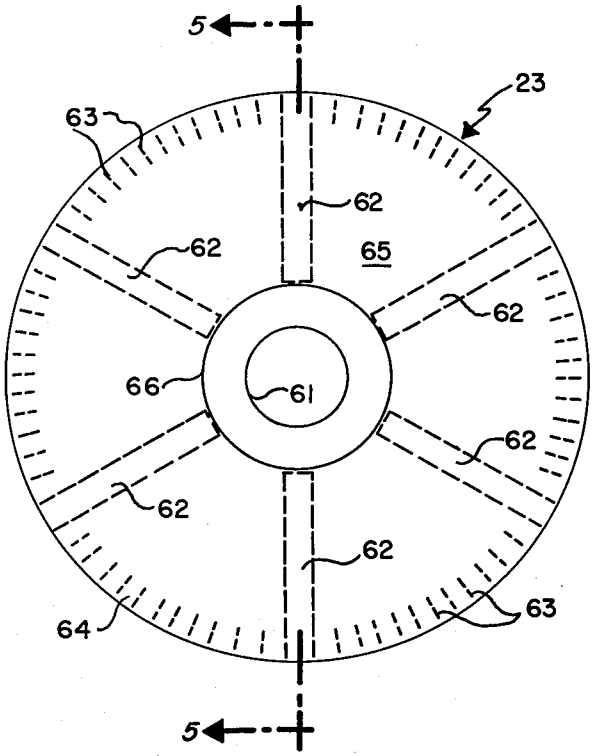
FIG. 4 is an end view of the slinger assembly shown in FIG. 1 viewed from the fan assembly side.

On the face of the plate 60 nearest the fan hub 45 as shown in FIG. 4, three or more vanes 62, preferably of rectangular cross-section, are mounted to extend radially inward from the periphery of the plate 60. The vanes 62 define equal-sized wedge-shaped channels between adjacent vanes 62 for water flow on the face of the plate 60. The vanes 62 allow water to build up in depth on the plate 60.

A plurality of circumferentially spaced fins 63 are mounted to protrude at the periphery of the plate 60 from the same face to which the vanes 62 are mounted. The fins 63 define a plurality of slots 64 between adjacent pairs of vanes 62.

The slinger assembly 23 also includes an optional second disc-shaped plate 65 mounted face to face with the first plate 60 so that vanes 62 are between the faces and the channels formed by the vanes 62 are enclosed. The second plate 65 thereby allows water to build up against the vanes 62 without such water slipping over the top of the vanes 62.

The second plate 65 has a cylindrical passage 66 through the center thereof which is larger in diameter than the passage 61 of the first plate 60. The large diameter of passage 66 allows the protruding ends of the hub conduits 54 to entered within the slinger assembly 23 and be counter-rotated. The protruding end of two conduits 54 are shown by dashed lines in FIG. 5.

Figure 6:
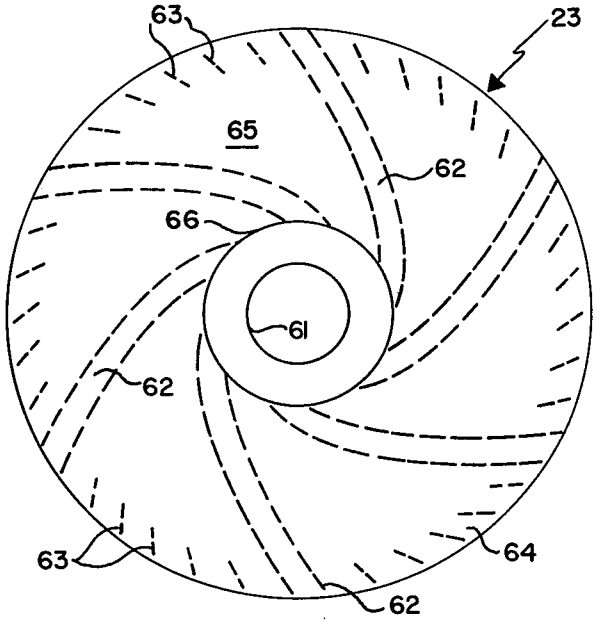
FIG. 6 is an end view of a slinger assembly having an alternative vane configuration to that shown in FIG. 4.

In FIG. 4, the vanes 62 are shown to extend from the periphery of the first plate 60 to the edge of the passage 66 of the second plate 65 so that the protruding ends of the hub conduits 54 can enter within the slinger assembly 23 radially inward of the vanes 62. Alternatively, the vanes 62 could extend (not shown) to the edge of the passage 61 of the first plate 60. In this alternative configuration the conduits 54 would be adjacent the vanes 62. Further, as shown in FIG. 6, the vanes 62 can alternatively be curved similarly to one another adjacent passage 66 to provide involute-shaped channels.

The cooperative arrangement of the fan assembly 22 and slinger assembly 23 is shown in FIG. 1. The openings of the channels at the periphery of the plate 60 are inward of, adjacent and circumscribed by the array of the tubular member 55 to provide shearing action. Further, the protrudings ends of the conduits 54 are radially inward of the vanes 62 and extend through passage 66 of the second plate 65 to adjacent the near face of the first plate 60 to feed water to the channels.

During operation of the humidifying apparatus, the fan assembly 22 and slinger assembly 23 are rotated in opposite directions by their respective motors 32 and 33. The rotation of the fan assembly 22 draws air past the periphery of the slinger assembly 23. This air is drawn into the housing 21 through inlets 25 and 26. The air is discharged from the housing 21 through outlet passage 27.

Water is fed to the chamber 49 through the pipe 53. From the chamber 49 the water, under a centrifugal force, moves through the conduits 54 and is emitted onto the plate 60. An approximately equal amount of water is fed into each of the channels defined by the vanes 62.

Under centrifugal force, the water fed into the channels moves outward to the periphery of the plate 60. At the periphery the slots 64 on the plate 60 and the array of the tubular member 55 are rotating in opposite directions. The interaction of the slots 64 and array shear the water so that a mist is emitted radially through the array. The mist is entrained by and humidifies the air passing the periphery of the plate 60.

It is apparent from the preceeding description that the vanes 62 and the second plate 65 allow an increased water film depth on the plate 60. Even further it is seen that the conduits 54 provide better distribution of water into the channels defined on the plate 60.

It it also apparent that the counter-rotation of the array of tubular member 55 with respect to the slinger assembly 23 provides an increased shearing action at the periphery of the slinger assembly 23.

It is further to be understood that the fan assembly 22 and slinger assembly 23 can alternatively be mounted on separate shafts which are coaxial. Even further it is to be understood that the flow of air past the fan assembly 22 and slinger assembly can be in the opposite direction; that is to say through the fan blades 46 and then past the slinger assembly 23 rather than past the slinger assembly 23 and then through the fan blades 46 as shown in FIG. 1.

We claim:

1. An improved humidifying apparatus comprising:

a. a fan assembly inclusive of
   i. a shaft,
   ii. a hub member mounted to rotate on said shaft, said hub member having a chamber formed therein to serve as a water plenum; and
   iii. fan blades mounted to extend from said hub member;

b. means to deliver water to said chamber;

c. a slinger assembly mounted to rotate coaxial with, independent of and adjacent to said hub member, said slinger assembly inclusive of
   i. a first disc-shaped plate having, on its face nearest said hub member, three or more vanes mounted on said nearest face to extend radially inward from the periphery of said first plate to define channels between adjacent vanes; and
   ii. a second disc-shaped plate mounted face to face with said first plate such that said vanes are between said faces and the channels formed by said vanes are enclosed, said second plate having a cylindrical passage formed in the center thereof;

d. three or more water-carrying conduits, said conduits extending from said chamber through the end of said hub member to protrude from said hub member and through said cylindrical passage of said second plate to adjacent said nearest face of said first plate such that said conduits extend within said slinger assembly, said conduits being equally spaced radially from said shaft to define a circle on which said conduits are evenly spaced so that said conduits evenly distribute water from said chamber onto said nearest face of said first plate such that water is impelled outwardly from said slinger assembly by centrifugal force; and e. a tubular member coaxially mounted to said hub member to rotate therewith, said tubular member including a plurality of fins spaced circumferentially from one another to form a cylindrical array which extends outward from said hub member to circumscribe said slinger assembly.

2. An improved humidifying apparatus according to claim 1 wherein said first disc-shaped plate further includes circumferentially spaced fins mounted to protrude from said nearest face of said first plate, said fins defining a plurality of slots between adjacent vanes.

* * * * *